US008618393B1

(12) United States Patent
Peters

(10) Patent No.: US 8,618,393 B1
(45) Date of Patent: Dec. 31, 2013

(54) STRAP ASSEMBLY FOR PLAYING A MUSICAL INSTRUMENT IN A SITTING OR STANDING POSITION WITH THE INSTRUMENT IN A FACE-UP POSITION

(76) Inventor: Janet K. Peters, Duncan, OK (US)

( * ) Notice: Subject to any disclaimer, the term of this patent is extended or adjusted under 35 U.S.C. 154(b) by 0 days.

(21) Appl. No.: 13/449,315

(22) Filed: Apr. 18, 2012

(51) Int. Cl.
*G10D 3/00* (2006.01)

(52) U.S. Cl.
USPC ..... 84/327

(58) Field of Classification Search
USPC ..... 84/327
See application file for complete search history.

(56) References Cited

U.S. PATENT DOCUMENTS

| | | | | | |
|---|---|---|---|---|---|
| 4,150,464 | A | | 4/1979 | Tracy | |
| 4,279,367 | A | * | 7/1981 | Jacobs | 224/257 |
| 4,930,695 | A | * | 6/1990 | Thompson et al. | 224/257 |
| 5,069,103 | A | | 12/1991 | Healy | |
| 5,483,860 | A | * | 1/1996 | Adams | 84/327 |
| 5,503,315 | A | | 4/1996 | Ruzika et al. | |
| 5,596,158 | A | * | 1/1997 | Tonon | 84/327 |
| 5,868,293 | A | | 2/1999 | D'Addario et al. | |
| 5,880,384 | A | | 3/1999 | Beck | |
| 5,936,173 | A | * | 8/1999 | Tonon | 84/327 |
| 6,199,731 | B1 | * | 3/2001 | Lehoux | 224/260 |
| 6,250,525 | B1 | * | 6/2001 | Lehoux | 224/257 |
| 6,359,203 | B1 | * | 3/2002 | Cronos | 84/327 |
| 6,581,812 | B2 | * | 6/2003 | Roscoe-Dare | 224/259 |
| 7,470,842 | B2 | | 12/2008 | Miller | |
| 7,586,029 | B2 | * | 9/2009 | Peavey et al. | 84/267 |
| 7,638,699 | B2 | * | 12/2009 | Buettgen | 84/387 A |
| 7,781,656 | B2 | | 8/2010 | Furuta | |
| 2010/0224050 | A1 | * | 9/2010 | Lockwood | 84/465 |
| 2012/0006177 | A1 | * | 1/2012 | Jackson et al. | 84/387 A |

* cited by examiner

*Primary Examiner* — David Warren
*Assistant Examiner* — Robert W Horn
(74) *Attorney, Agent, or Firm* — Kenneth A. Roddy

(57) ABSTRACT

A strap assembly worn by a player in a sitting or standing position for supporting a guitar or similar instrument in a generally horizontal face-up position, stabilizes the instrument while it is being played without impeding freedom of movement of the player's hands. The strap assembly includes an elongate shoulder strap, a shoulder pad slidably mounted on the shoulder strap, an instrument headstock strap releasably connected to a first end of the shoulder strap having a looped end for attachment to the instrument headstock, an instrument body strap releasably connected to a second end of the shoulder strap for attachment to the body of the instrument, and a forearm loop mounted on the instrument body strap for receiving the forearm of the picking-hand of the instrument player.

20 Claims, 7 Drawing Sheets

38
38A
38B
36C
39
36B
36D
38D, 40
38C
36D
36A
36
37

36C
38A
38
38B
39
36B
36D
38D, 40
36A
38C
36
37
14
14A
11B
12A
11
12
12A
11A
31A
30A
32B
30
31B
32A
30B
34C
34
34B
33
34A
35A
35D
35
35B
35C
10B

STRAP ASSEMBLY FOR PLAYING A MUSICAL INSTRUMENT IN A SITTING OR STANDING POSITION WITH THE INSTRUMENT IN A FACE-UP POSITION

BACKGROUND OF THE INVENTION

1. Field of the Invention

This invention relates generally to support straps for supporting musical instruments, and, more particularly, to an instrument strap assembly to be worn by a player in a sitting or standing position for supporting a musical instrument, such as a guitar, in a face-up horizontal position that stabilizes the instrument while being played without impeding freedom of movement of the player's hands.

2. Background Art

A conventional "two-point" guitar strap typically has a buttonhole at each end that is slipped over a small strap button (also known as a lug, end pin, or knob), one at the bottom end of the guitar body or "lower bout", and the other at the neck end or fret board end, of the body, that are secured to the guitar by a variety of fastening means. The conventional "two-point" guitar strap is designed primarily to support the guitar on front of the player by the strap buttons at the bottom end of the guitar body or "lower bout", and the neck end or heel of the fret board with the face and playing surface or strings of the guitar facing outwardly from the player.

An acoustic lap steel guitar, also commonly referred to as a "DoBro", or resonator or resophonic guitar, or slide guitar are played using a metal slide called a "steel" (or tone bar) or a tube slipped over a finger to engage the strings of the guitar instead of pressing down on the string to engage the frets of the guitar. These types of guitars are often played with the guitar disposed horizontally with the strings facing upward with the guitar supported across the knees of a seated player, or on a stool or platform in front of the seated player. The metal slide is held by, or the tube is slipped over a finger of, the player's left hand and moved along the strings to change the instrument's pitch while the right hand plucks the strings (if they are right hand players). As used herein, the term "fret-hand" refers to the hand that moves the bar or slide. The term "picking-hand" refers to the opposite hand of the fret-hand; this is the hand that plucks the strings.

The "DoBro" guitar, introduced in 1928 by the Dopyera Brothers, is an acoustic slide guitar which has a metal resonator in the middle of the soundboard. The term "DoBro" is a contraction of Dopyera and Brothers, and has become a generic term to identify guitars having a metal resonator on the soundboard.

The "DoBro" type guitars are preferably played in a standing position with the guitar disposed horizontally and the face and strings of the guitar facing upward. This is because the standing position permits full output from the acoustic instrument because the backside of the guitar is free to resonate, as opposed to being pressed against the player's body or lap. These types of guitars also project sound better in a position tilted slightly away from the body and toward the listener or microphone.

It is very difficult to stabilize and to play a "DoBro" or acoustic lap steel instrument, or an electric lap steel in a standing position while maintaining the face and strings of the guitar facing upward using a conventional two-point guitar strap because the guitar is supported at a point at each end of the guitar and tends to rotate or roll about the horizontal axis of the guitar body. In some cases, the guitar will roll such that the strings face either toward the player's stomach, or face outwardly away from the player's stomach.

Another problem with suspending these types of guitars horizontally from a conventional two-point strap with the face and strings of the guitar facing upward is that the shape of the body is usually the traditional figure-8 shape with a rounded butt-end, similar to the shape of regular acoustic guitars. Thus, the playing surface (fret board) is disposed to the left of center of the player's body (for a right handed player), and the guitar tends to center itself on the two-point strap, which can move the fret board out of the preferred position, such that the player's fret-hand (the hand that moves the bar or slide) cannot easily access the higher frets of the guitar.

Some players attempt to stabilize the guitar with the underside of their right forearm (if they are right-handed players), or with the heel of their right hand ("picking-hand"). Other players (if they are right-handed players) place the shoulder strap over their left shoulder, and place their right forearm under the right hand end of the strap to stabilize the guitar. Still other players (if they are right-handed players) place their right arm over top of the strap then around the outside and under the strap such that the strap has a half twist around their right forearm.

With these techniques, the right arm and left shoulder area are the main points of contact on the player's body that hold the weight of the guitar and the forearm of the "picking-hand" is trapped between the strap and the guitar body. These methods of support also limit the freedom of movement of the player's "picking-hand" that plucks the strings, and also tend to move the fret board and headboard around. In the standing position, after extended play, there is a tendency for the picking-hand to become numb from lack of blood circulation to the hand. A portion of the instrument weight and a portion of the downward force caused by barring the frets and picking the strings are transferred to the player's forearm and picking-hand via the strap. These loads are transferred because the forearm is trapped and the portion of the strap at the player's shoulder does not carry the entire playing load.

Peavey et al, U.S. Pat. No. 7,586,029 discloses a guitar and strap for playing in a standing configuration wherein the guitar is suspended from a strap about a player's shoulder with a front plane of the guitar oriented generally horizontally. The guitar includes a horn extending from the body transversely with respect to the neck to a tip of the horn, the horn including a curvate edge extending from the tip toward a bottom of the body for engaging a fret-hand side of the player. The tip and the curvate edge of the horn are sized and shaped such that the body and neck are offset towards the fret-hand side of the player when suspended, thereby giving the player ready access to higher frets of the neck. In preferred embodiments, the guitar includes at least three strap buttons disposed about the neck and body; and a strap coupled to the strap buttons such that the guitar is suspended from the strap at three points.

There are also several patents directed toward support straps for supporting musical instruments, such as guitars, with the face and playing surface or strings thereof facing outwardly from the player, but are not particularly suited to for supporting an instrument, such as a guitar, from a player in a standing position with the instrument disposed horizontally with the face and playing surface or strings thereof facing upward.

Healy, U.S. Pat. No. 5,069,103 discloses a belt-hook assembly that is attached to the rear surface of the body of an instrument, and the musician wears a belt assembly having a depending strap segment fastened thereto which buckles to a second strap segment that is attached to the base of the instrument's body.

Ruzika et al, U.S. Pat. No. 5,503,315 discloses a shoulder strap having an arcuate or bow-like curved first support portion configured to lie across the back of the player, and a linear second support portion that lies across the player's shoulder. Each end of the shoulder strap is adapted to attach to a musical instrument by means of a pivot member and a connecting element.

Tonon, U.S. Pat. No. 5,596,158 discloses a three-point harness strap for suspending a musical instrument which has a main body and an extension, with a first connector for attaching the strap to the main body of the instrument, a second connector for attaching the strap to the extension of the instrument from its main body, and a third connector between the first and second connectors and for attachment to the instrument between its main body and extension for limiting the extent to which the strap can be displaced from the body of the instrument.

D'Addario et al, U.S. Pat. No. 5,868,293, which is incorporated herein by reference, discloses a quick release musical instrument strap attachment, known as the Acoustic-Quick Release System which is manufactured and marketed by the Planet Waves division of D'Addario & Company, Inc., of Farmingdale, N.Y. The quick release system includes a strap attachment unit and a musical instrument attachment unit. The strap attachment unit has a female receiving quick release portion with a base portion and a hollow body portion for receiving and locking a male quick release portion with a first cord having both ends thereof attached to the base portion of the female quick release portion to form a loop. The musical instrument attachment unit has a male quick release insertion unit with a base portion and an insertion means adapted for insertion and locking into the hollow body portion of the female receiving quick release portion, and a second cord having both ends thereof attached to the base portion of the male receiving quick release portion to form a loop. The strap attachment unit is attachable to a strap and the musical instrument attachment unit is attachable to the musical instrument.

Beck, U.S. Pat. No. 5,880,384 discloses a connecting device for attaching a shoulder strap to the neck of the instrument. The device has a looped portion which extends beneath the strings along one side of the neck, and across the bottom of the neck to encircle the neck with opposite ends adjacent the top edge of the neck. A fastener joins the end portions of the looped portion together, and is provided with a stem and a head over which a slotted end of the guitar strap may be manipulated to rest on the stem and be retained on the fastener by the head.

Lehoux, U.S. Pat. No. 6,199,731 discloses a double strap harness having right and left shoulder strap systems and a back connecting system for supporting and positioning a guitar or similar instrument in front of a player with the strings facing outwardly from the player. The right shoulder strap system extends over the right shoulder and is mounted on the strumming end of the guitar. The left shoulder strap system includes two straps extending over the left shoulder mounted to the front and back of the player, and a strap mounted on the fret end of the guitar. The back connecting system ties the right and left strap systems together.

Miller, U.S. Pat. No. 7,470,842 discloses a cradle for a musical instrument, which consists of a support having a figure-8 configuration including a pair of loops adapted to support the musical instrument without the use of any fastening device. The cradle has a strap with a pair of ends, each of which is connected to a loop of the support. A buckle may be provided to adjust the length of the strap. In use, a musical instrument is positioned in the inventive cradle with the loops supporting the instrument in front of a player with the strings facing outwardly from the player.

Furuta, U.S. Pat. No. 7,781,656 discloses a strap for a guitar that has a strap belt and two strap connectors each of which is provided at each end of the strap belt. Each strap connector includes a base plate with a first opening, a second opening, and a slit. The first opening has a diameter greater than a head portion of a connector pin. The second opening has a diameter smaller than a neck portion of the connector pin. The slit connects the first and second openings and has a width smaller than the diameter of a neck portion of the connector pin.

SUMMARY OF THE INVENTION

The present invention overcomes the aforementioned problems and is distinguished over the prior art in general, and these patents in particular by a instrument strap assembly to be worn by a player in a sitting or standing position for supporting a musical instrument, such as a guitar, in a horizontal face-up position that stabilizes the instrument while being played without impeding freedom of movement of the player's hands. The strap assembly includes an elongate shoulder strap, a shoulder pad slidably mounted on the shoulder strap, an instrument headstock strap releasably connected to a first end of the shoulder strap having a looped end for attachment to the guitar headstock, an instrument body strap releasably connected to a second end of the shoulder strap for attachment to the body of the guitar, and a forearm loop pivotally mounted on the instrument body strap for receiving the forearm of the picking-hand of the guitar player.

One of the significant features and advantages of the present strap assembly is that it supports each end of the guitar in a horizontal face-up position in a manner that prevents the tendency of the guitar to rotate or roll about the horizontal axis of the guitar body.

Another significant feature and advantage of the present strap assembly is that it will better maintain the fret board in a preferred playing position and stabilize the instrument while being played without impeding freedom of movement of the player's hands, and provide control of the tendency of the instrument to turn about the player's body.

Another feature and advantage of the present strap assembly is that it will stabilize the guitar and eliminate the practice of a player trying to stabilize the guitar with the underside of their forearm or heel of their picking-hand, or placing the forearm of their picking-hand under the strap or twisting the strap to stabilize the guitar.

Another feature and advantage of the present strap assembly is that it will eliminate trapping the forearm of the picking-hand between the strap and the guitar body, and will allow freedom of movement of the player's picking-hand, and aid in maintaining the wrist of the picking-hand in a neutral position.

Another feature and advantage of the present strap assembly is that the strap provides swivel connections between the ends of the shoulder strap and the neck and the body of the guitar which allows the shoulder strap to lie flat against the player's back and also allows the forearm loop to lie flat around the top of the forearm of the picking-hand.

A further feature and advantage of the present strap assembly is that it will eliminate transferring the instrument weight and downward force to the forearm of the player's picking-hand.

Still further features and advantages of the present strap assembly are that it is attractive in appearance, simple in construction, inexpensive to manufacture, and rugged and reliable in use.

Other features and advantages of the invention will become apparent from time to time throughout the specification and claims as hereinafter related.

DESCRIPTION OF THE PREFERRED EMBODIMENTS

Figures 1, 1A, 1B:
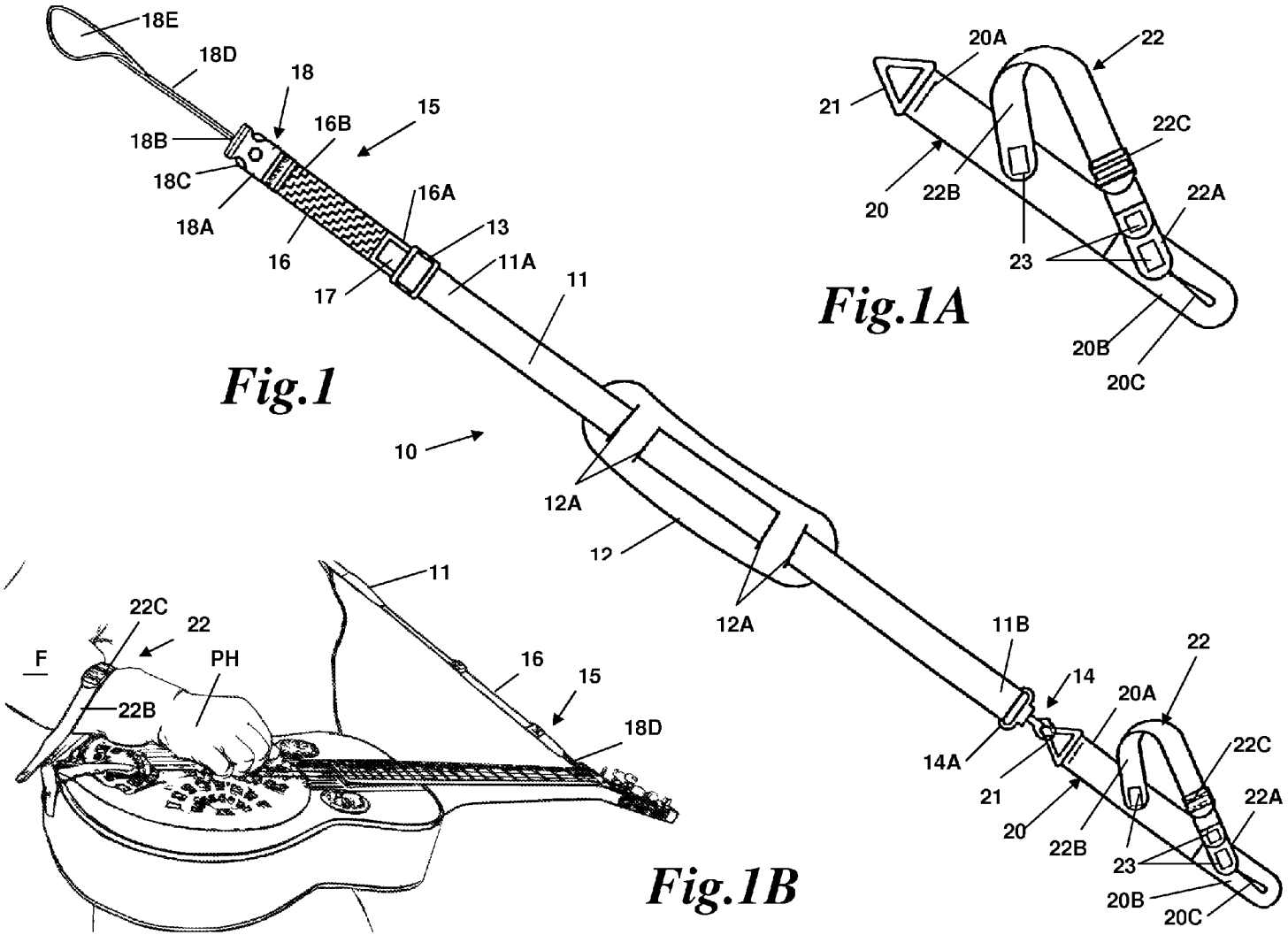
FIG. 1 is a plan view of the strap assembly in accordance with the present invention, showing the main shoulder strap, shoulder pad, quick-release instrument headstock strap assembly, instrument body strap, and the forearm loop in an assembled condition.
FIG. 1A is an enlarged plan view of the instrument body strap and the forearm loop at the second end of the strap assembly.
FIG. 1B is a pictorial illustration showing the main shoulder strap placed over the shoulder of a player and the player's picking-hand placed through the adjustable forearm loop with the instrument disposed generally horizontally with the face and strings facing upward.

Referring to the drawings by numerals of reference, there is shown in FIGS. 1, 1A, and 1B, a preferred instrument strap assembly 10 in accordance with the present invention. As described in greater detail hereinafter, the major components of the strap assembly 10 includes an elongate main shoulder strap 11, a shoulder pad 12 slidably mounted on the main shoulder strap, a quick-release instrument headstock strap assembly 15 releasably connected to a first end of the main shoulder strap having a looped end for attachment to the guitar headstock, an instrument body strap 20 releasably connected to a second end of the shoulder strap for attachment to the body of the guitar, and a forearm loop 22 mounted on the instrument body strap for receiving the forearm of the picking-hand of the guitar player.

The main shoulder strap 11 is an elongate flexible strap made of a sturdy flexible material such as, for example, nylon webbing, leather, or other suitable flexible material, having opposed first and second ends 11A and 11B, respectively. The main shoulder strap 11 is fed through a longitudinally spaced pair of transverse slots 12A of the shoulder pad 12 such that the shoulder pad is slidably mounted on the main shoulder strap between the opposed ends 11A and 11B. A buckle 13 is secured to the first end 11A of the main shoulder strap 11. The second end 11B of the main shoulder strap 11 is fed though through the eyelet 14A of a quick disconnect snap-hook swivel connector 14 and then doubled back over itself and sewn together.

The quick-release instrument headstock strap assembly 15 includes a strap member 16 made of a sturdy flexible material such as, for example, nylon webbing, leather, or other suitable flexible material, having a first end 16A which is fed through the buckle 13 at the first end 11A of the main shoulder strap 11 to form an adjustable loop that allows the length of the strap member 16 to be adjusted. A reinforcement tab 17 may be sewn onto the first end 16A of the strap member 16 after it is fed through the buckle 13 to increase its thickness and prevent it from pulling out of the buckle.

The second end 16B. of the strap member 16 is secured to the female member 18A of a quick-release connector 18. A preferred quick release connector 18, as illustrated in the drawings, is a side-release buckle of the type sold by ITW Nexus Global of Des Plains, Ill., and covered by U.S. Pat. No. 4,150,464, which is incorporated herein by reference. The quick-release connector 18 includes the separable female receptacle 18A and a male clasp member 18B, preferably molded of a thermoplastic material. The clasp member 18B includes a pair of resilient arms having locking tabs 18C thereon for releasably engaging locking slots of the receptacle member 18A. The receptacle member 18A also includes a pair of grooves for slidably engaging cooperating raised ridges formed on a central arm of the clasp member for guiding the clasp member during insertion and removal from the receptacle member (conventional and therefore not shown in detail). The quick-release instrument headstock strap assembly 15 includes a flexible cord 18D formed into a loop 18E, the ends of which are secured to the male clasp member 18B of the quick release connector 18 by conventional means, such as by an adhesive, or a molding process. The flexible cord 18D is formed of a relatively sturdy material, such as nylon.

While this type of connector is preferred, other forms of quick release connectors or buckles may also be employed. The connector elements 18A, 18B, of the quick release connector 18 are easily connected such that the looped cord 18E extends from the second end 11A of the strap member 16 at the end of the main shoulder strap 11. It should be understood that either of the male or female member 18A or 18B of the quick-release connector 18 may be secured to the strap member 16, and the other connector member provided with the looped cord 18E.

The looped cord 18D of the instrument headstock strap assembly 16 may be passed around the headstock of the guitar under the strings between the endmost two sets of the tuning knobs or keys, and the male connector element 18B of the quick release connector 18 passed through the loop 18E formed by the cord in order to tightly secure the instrument headstock strap 16 and connector 18B to the guitar. Thus, it should be understood, that the looped cord 18D may remain secured to the headstock of the instrument, and that the strap 16 at the end of the main shoulder strap 11 can be selectively connected thereto and therefrom by the male and female connector elements 18A and 18B. When connected, the flexible cord 18D of the headstock strap assembly 15 provides a swivel joint between the first end 11A of the main shoulder strap 11 and the neck of the instrument.

As described above, the second end 11B of the main shoulder strap 11 is fed though through the eyelet 14A of a quick disconnect snap-hook swivel connector 14 and then doubled back over itself and sewn together.

The instrument body strap 20 is a flexible strap made of a sturdy flexible material such as, for example, nylon webbing, leather, or other suitable flexible material, having opposed first and second ends 20A and 20B, respectively. A ring 21 is secured to the first end 20A of the instrument body strap 20 by passing the end of the strap through the eyelet of the ring, doubling it back over and securing it to itself. The ring 21 is sized and shaped to receive the quick disconnect snap-hook swivel connector 14 at the second end 11B of the main shoulder strap 11. When connected, the quick disconnect snap-hook swivel connector 14 provides a swivel joint between the second end 11B of the shoulder strap 11 and the body of the instrument. The second end 20B of the instrument body strap 20 is provided with a somewhat teardrop-shaped aperture 20C having a larger opening near the outer end of the strap for receiving a conventional strap button secured to the guitar body at its bottom end or lower bout.

In this embodiment, the forearm loop 22 is an adjustable flexible strap made of two straps 22A and 22B formed of a sturdy flexible material such as, for example, nylon webbing, leather, or other suitable material. One end of each strap 22A and 22B is secured to the instrument body strap 20 in longitudinally spaced relation a distance inwardly from the button receiving aperture 20C, such as by sewing. A buckle 22C is secured to the free end of the first strap 22B, and the free end of the second strap 22A is fed though through the buckle 22C to form an adjustable loop that allows the length of the forearm loop 22 to be adjusted to ergonomically fit the forearm of the player.

Depending upon the material used for the instrument body strap 20 and the forearm loop 22, reinforcement tabs 23 may be sewn onto the straps 22A and 22B when they are secured to the instrument body strap to prevent separation. A reinforcement tab 23 may be also be sewn on the free end of the second strap 22B of the forearm loop 22 after it is fed through the buckle 22C to prevent it from pulling out of the buckle and allowing separation of the adjustable forearm loop 22. This feature further prevents loss of the holding mechanism, or in the catastrophic case, prevents the instrument from falling to the ground. FIG. 1B shows the main shoulder strap 11 placed over the shoulder of a player and the player's picking-hand PH placed through the adjustable forearm loop 22 with the instrument disposed generally horizontally with the face and strings facing upward.

Figures 2, 2A:
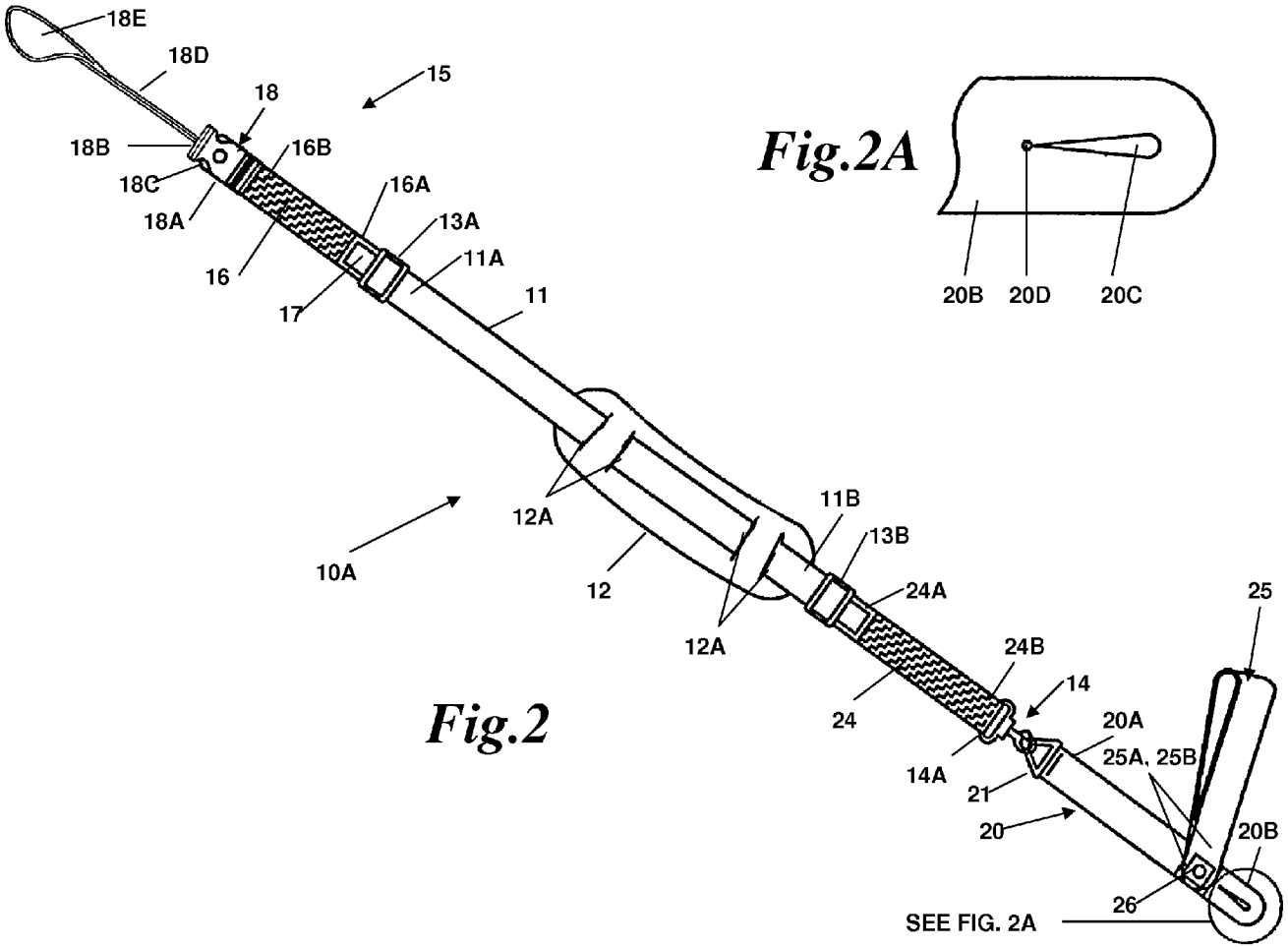
FIG. 2 is a plan view of the strap assembly in accordance with a second embodiment of the present invention, showing the main shoulder strap, shoulder pad, quick-release instrument headstock strap assembly, instrument body strap, and the forearm loop in an assembled condition.
FIG. 2A is an enlarged top plan view of a portion of the second end of the instrument body strap member of the strap assembly more clearly showing the aperture for receiving the button on the guitar body.

Referring now to FIGS. 2 and 2A, a second embodiment of the strap assembly 10A in accordance with the present invention is shown. This embodiment is substantially similar the embodiment of FIG. 1 and includes many of the same components. The components that are the same as described previously are assigned the same numerals of reference, but will not be described again in detail to avoid repetition.

In this embodiment, the strap assembly 10A includes an elongate main shoulder strap 11, and the shoulder pad 12 slidably mounted on the main shoulder strap, the quick-release instrument headstock strap assembly 15 releasably connected to a first end of the main shoulder strap having a looped end for attachment to the guitar headstock, and the instrument body strap 20, as shown and described previously.

This embodiment differs from the previous embodiment in that a first buckle 13A is secured to the first end 11A of the main shoulder strap 11 and a second buckle 13B is secured to the second end 11B of the main shoulder strap 11, and an intermediate adjustment strap 24 made of a sturdy flexible material such as, for example, nylon webbing, leather, or other suitable flexible material, has a first end 24A which is fed through the buckle 13B at the second end 11B of the main shoulder strap 11 to form an adjustable loop that allows the length of the strap member 24 to be adjusted. The intermediate adjustment strap 24 has a second end 24B that is fed though through the eyelet 14A of a quick disconnect snap-hook swivel connector 14 and then doubled back over itself and sewn together.

In this embodiment, the ring 21 secured to the first end 20A of the instrument body strap 20 receives the quick disconnect snap-hook swivel connector 14 at the second end 24B of the intermediate adjustment strap 24. The intermediate adjustment strap 24 and the swivel connector 14 provide a swivel joint between the second end 11B of the shoulder strap 11 and the body of the instrument. As with the previous embodiment, the second end 20B of the instrument body strap 20 is provided with a somewhat teardrop-shaped aperture 20C having a larger opening near the outer end of the strap for receiving a conventional strap button secured to the guitar body at its bottom end. As best seen in FIG. 2A, the tapered sides of the teardrop-shaped aperture 20C converge into a small hole 20D opposite the wider end of the aperture.

The forearm loop in this embodiment also differs from the previous embodiment. In this embodiment, the forearm loop 25 for receiving the forearm of the picking-hand of the guitar player is a flexible strap made of a sturdy flexible material such as, for example, nylon webbing, leather, or other suitable material, having first and second ends 25A, 25B which are joined together and pivotally mounted by a pivot connection 26 on the instrument body strap 20 a distance inwardly from the button receiving aperture 20C.

Figures 3, 3A:
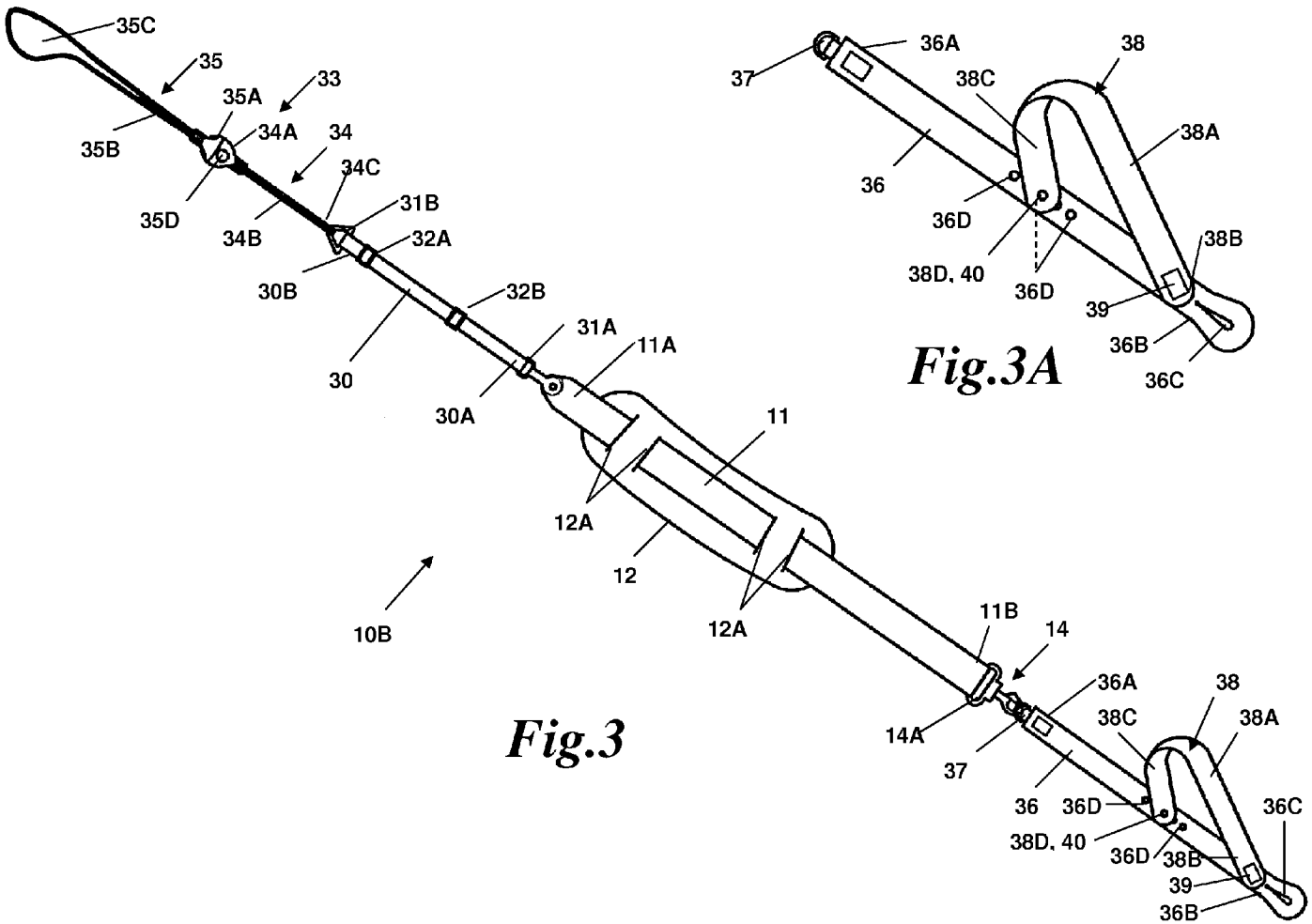
FIG. 3 is a plan view of the strap assembly in accordance with a third embodiment of the present invention, showing the main shoulder strap, shoulder pad, quick-release instrument headstock strap assembly, instrument body strap, and the forearm loop in an assembled condition.
FIG. 3A is an enlarged plan view of the instrument body strap and the forearm loop at the second end of the strap assembly.

Referring now to FIGS. 3 and 3A, a third embodiment of the strap assembly 10B in accordance with the present invention is shown. This embodiment is substantially similar the previous embodiments of FIGS. 1 and 2, and includes many of the same components. The components that are the same as described previously are assigned the same numerals of reference, but will not be described again in detail to avoid repetition.

In this embodiment, the strap assembly 10B includes an elongate main shoulder strap 11, a shoulder pad 12 slidably mounted on the main shoulder strap, a length adjustment strap 30 connected to a first end of the main shoulder strap, a quick-release instrument headstock strap assembly 33 releasably connected to the length adjustment strap, an instrument body strap 36, and an adjustable forearm loop 38.

The main shoulder strap 11 is an elongate flexible strap made of a sturdy flexible material such as, for example, leather, nylon webbing, or other suitable flexible material, having opposed first and second ends 11A and 11B, respectively. The main shoulder strap 11 is fed through a longitudinally spaced pair of transverse slots 12A of the shoulder pad 12 such that the shoulder pad is slidably mounted on the main shoulder strap between the opposed ends 11A and 11B. A first ring 31A is secured to the first end 11A of the main shoulder strap 11. The second end 11B of the main shoulder strap 11 is fed though through the eyelet 14A of a quick disconnect snap-hook swivel connector 14 and then doubled back over itself and sewn together.

A length adjustment strap 30 made of a sturdy flexible material such as, for example, leather, nylon webbing, or other suitable flexible material, has a first end 30A which is fed through the first ring 31A at the first end 11A of the main shoulder strap 11, and a second end 30B looped through a second ring 31B a distance therefrom and secured by a first slide buckle 32A. The free end of the length adjustment strap 30 is secured to a second slide buckle 32B slidably mounted on the length adjustment strap to form an adjustable loop that allows the length of the adjustment strap to be adjusted.

In this embodiment, the quick-release instrument headstock strap assembly 33 utilizes a conventional commercially available quick release instrument strap attachment of the type known as the Acoustic-Quick Release System, manufactured and marketed by the Planet Waves division of D'Addario & Company, Inc., of Farmingdale, N.Y., and covered by U.S. Pat. No. 5,868,293, which is incorporated herein by reference.

The quick-release instrument headstock strap assembly 33 includes a strap attachment unit 34 and a musical instrument attachment unit 35. The strap attachment unit 34 includes a separable female receptacle 34A with a first flexible cord 34B having both ends thereof attached to the female receptacle to form a first loop 34C. The first looped cord 34B passes through the second ring 31B at the second end 30B of the length adjustment strap 30, and the female receptacle 34A is passed through the loop 34C formed by the cord to secure the female receptacle to the length adjustment strap. The musical instrument attachment unit 35 of the quick-release instrument headstock strap assembly 33 includes a male clasp member 35A with a second cord 35B having both ends thereof attached to the clasp member to form a second loop 35C. The male clasp member 35A includes resilient arms having locking tabs 35D thereon for releasably engaging locking apertures of the female receptacle member 34A. The quick-release instrument headstock strap assembly 33 is a conventional commercially available device, and therefore the internal components are not shown or described in detail.

The female receptacle 34A and male clasp 35A of the quick-release headstock strap assembly 33 are easily connected such that the first looped cord 34B extends from the ring 31B at the second end 30B of the length adjustment strap 30 at the first end 11A of the main shoulder strap 11 and the second looped cord 35B extends from the male clasp member 35A. The second looped cord 35B may be passed around the headstock of the guitar under the strings between the endmost two sets of the tuning knobs or keys, and the male clasp 35A passed through the second loop 35C formed by the cord in order to tightly secure the quick-release headstock strap assembly 33 to the guitar. Thus, it should be understood, that the male clasp 35A of quick-release headstock strap assembly 33 may remain secured to the headstock of the instrument, and that the female receptacle member 34A at the end of the length adjustment strap 30 can be selectively connected thereto and therefrom. When connected, the flexible cords 34B and 35B of the quick-release headstock strap assembly 33 provide a swivel joint between the main shoulder strap 11 and the neck of the instrument. It should be understood that looped cord of either of the female receptacle or male or female member may be secured to the length adjustment strap 33, and the other cord attached to the headstock of the guitar.

As described above, the second end 11B of the main shoulder strap 11 is fed though through the eyelet 14A of a quick disconnect snap-hook swivel connector 14 and then doubled back over itself and sewn together.

The instrument body strap 36 is a flexible strap made of a sturdy flexible material such as, for example, leather, nylon webbing, or other suitable flexible material, having opposed first and second ends 36A and 36B, respectively. A ring 37 is secured to the first end 36A of the instrument body strap 36. The ring 37 is sized and shaped to receive the quick disconnect snap-hook swivel connector 14 at the second end 11B of the main shoulder strap 11. When connected, the quick disconnect snap-hook swivel connector 14 provides a swivel joint between the second end 11B of the shoulder strap 11 and the body of the instrument. The second end 36B of the instrument body strap 36 is provided with a somewhat teardrop-shaped aperture 36C having a larger opening near the outer end of the strap for receiving a conventional strap button secured to the guitar body at its bottom end. A plurality of holes 36D are formed in the instrument body strap 36 in longitudinally spaced relation a distance inwardly from the button receiving aperture 36C.

In this embodiment, the forearm loop 38 is formed of a flexible strap 38A made of sturdy flexible material such as, for example, leather, nylon webbing, or other suitable material. A first end 38B of the forearm loop strap 38A is secured to the instrument body strap 36 a short distance inwardly from the button receiving aperture 36C, such as by sewing. Depending upon the material used for the instrument body strap 36 and the forearm loop 38, a reinforcement tab 39 may be sewn onto the strap 38B when it is secured to the instrument body strap to prevent separation. The free end 38C of the forearm loop strap 38A is provided with a hole 38D which can be axially aligned with a selected respective hole 36D of the instrument body strap 36. A commercially available separable fastener 40, such as a "Chicago fastener" is removably installed through aligned holes 36D, 38D. Thus, the free end of the forearm loop 38 can be secured at selected distances from the attached end to allow the length of the forearm loop to be adjusted to ergonomically fit the forearm of the player.

Figure 4:
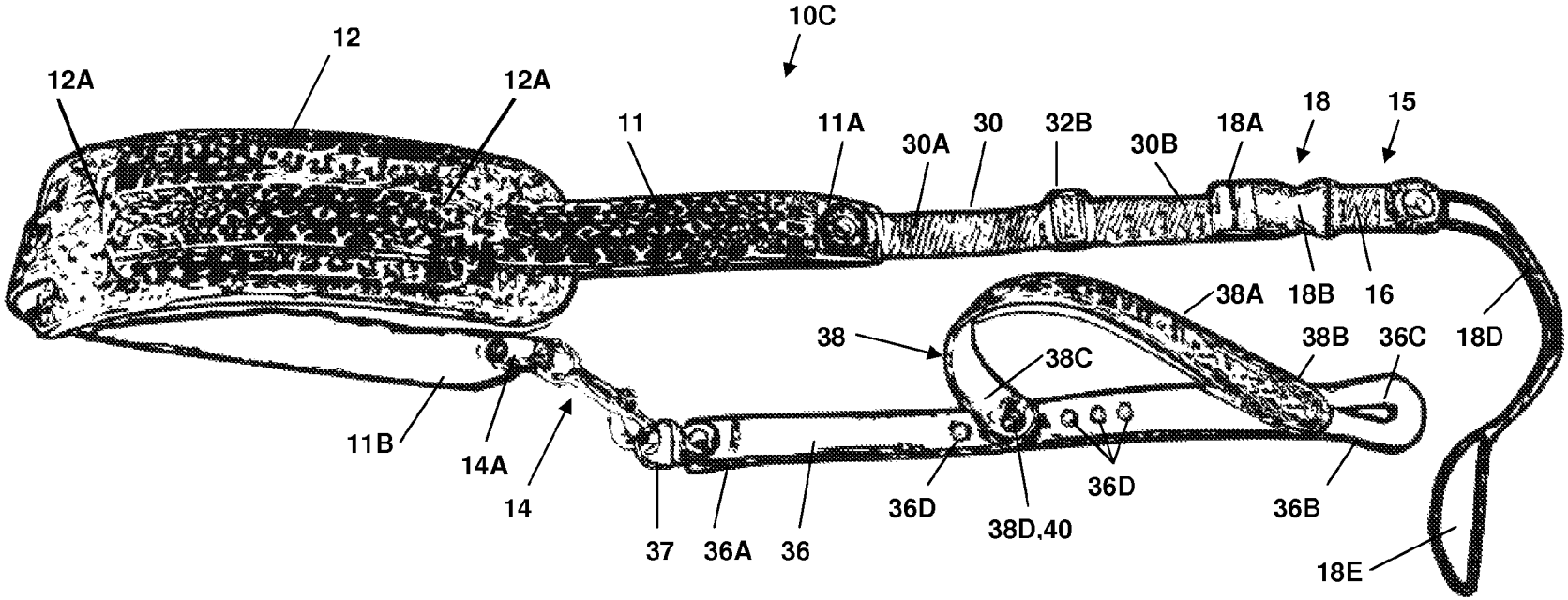
FIG. 4 is a pictorial illustration showing a modification of the present invention which incorporates the quick-release instrument headstock strap assembly of FIG. 1, and the main shoulder strap, shoulder pad, length adjustment strap, instrument body strap, and forearm loop of FIG. 3.

It should be understood that the components of the strap assembly described above may be interchanged to form instrument strap assemblies in accordance with the present invention. For example, FIG. 4 shows a modification of the strap assembly 10C which incorporates the quick-release instrument headstock strap assembly 15 of FIG. 1, and the main shoulder strap 11, shoulder pad 12, length adjustment strap 30, instrument body strap 36, and forearm loop 38 of FIG. 3. The components described previously are assigned the same numerals of reference, but will not be described again in detail to avoid repetition.

In this modification, the main shoulder strap 11 is fed through a longitudinally spaced pair of transverse slots 12A of the shoulder pad 12. The first end 30A of the length adjustment strap 30 is secured to the first end 11A of the main shoulder strap 11 by a conventional fastener, and its free end 30B is looped through female receptacle 18A of the quick-release connector 18, and secured to a slide buckle 32B slidably mounted on the length adjustment strap to form an adjustable loop that allows the length of the adjustment strap to be adjusted. A preferred quick release connector 18, as illustrated in the drawings, is a side-release buckle of the type sold by ITW Nexus Global of Des Plains, Ill., and covered by U.S. Pat. No. 4,150,464, which is incorporated herein by reference.

The quick-release connector 18 includes the female receptacle 18A and a male clasp member 18B, as shown described in detail previously.

The quick-release instrument headstock strap assembly 15 includes a flexible cord 18D formed into a loop 18E, the ends of which are secured to the male clasp member 18B of the quick release connector 18 by a short strap member 16 and a conventional fastener. The flexible cord 18D is formed of a relatively sturdy material, such as nylon.

While this type of connector is preferred, other forms of quick release connectors or buckles may also be employed. The connector elements 18A, 18B, of the quick release connector 18 are easily connected such that the looped cord 18E extends from the second end 11A of the strap member 16 at the end of the main shoulder strap 11. It should be understood that either of the male or female member 18A or 18B of the quick-release connector 18 may be secured to the strap member 16, and the other connector member provided with the looped cord 18E.

The looped cord 18D of the instrument headstock strap assembly 16 may be passed around the headstock of the guitar under the strings between the endmost two sets of the tuning knobs or keys, and the male connector element 18B of the quick release connector 18 passed through the loop 18E formed by the cord in order to tightly secure the instrument headstock strap 16 and connector 18B to the guitar. Thus, it should be understood, that the looped cord 18D may remain secured to the headstock of the instrument, and that the strap 16 at the end of the main shoulder strap 11 can be selectively connected thereto and therefrom by the male and female connector elements 18A and 18B. When connected, the flexible cord 18D of the headstock strap assembly 15 provides a swivel joint between the first end 11A of the main shoulder strap 11 and the neck of the instrument.

As described previously above with reference to FIGS. 3 and 3A, the second end 11B of the main shoulder strap 11 is fed though through the eyelet 14A of a quick disconnect snap-hook swivel connector 14 and then doubled back over itself and sewn together.

The instrument body strap 36 and the forearm loop 38 in this modification is essentially the same as described previously above with reference to FIGS. 3 and 3A. A ring 37 is secured to the first end 36A of the instrument body strap 36 and receives the quick disconnect snap-hook swivel connector 14 at the second end 11B of the main shoulder strap 11. The first end 38B of the forearm loop strap 38A is secured to the instrument body strap 36 a short distance inwardly from the button receiving aperture 36C. The free end 38C of the forearm loop strap 38A can be axially aligned with a selected hole 36D of the instrument body strap 36 and hole 38D and removably secured by a commercially available separable fastener 40, such as a "Chicago fastener". Thus, allowing the length of the forearm loop to be adjusted to ergonomically fit the forearm of the player.

Operation

In the following discussion and related drawing figures, the instrument strap assembly 10C of FIG. 4 is used for purposes of example only, and not limited thereto, and the components of the strap assembly are illustrated somewhat schematically in FIGS. 5, 6, 7, 8, and 9.

In use, if not previously connected, the looped cord 18D of the quick-release headstock strap assembly 15 is connected around the headstock of the guitar under the strings, and the aperture 36C of the instrument body strap 36 is fastened over the strap button B at the bottom end, or lower bout, of the guitar body. The quick-release instrument headstock strap 15 is connected to the length adjustment strap 30 at the first end of the main shoulder strap 11 by connecting the quick-release elements of the quick release connector 18. The instrument body strap 36 is connected to the second end of the main shoulder strap 11 by connecting the snap-hook swivel connector 14 to the ring of the instrument body strap, as described previously.

Figure 5:
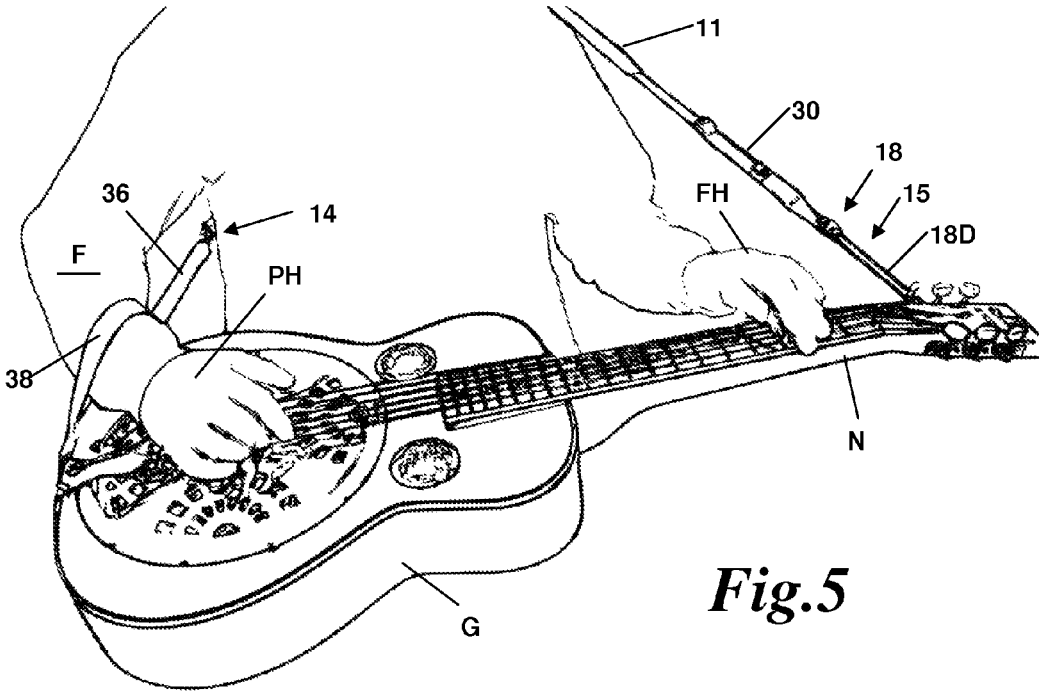
FIG. 5 is a pictorial illustration showing the main shoulder strap placed over the shoulder of a player and the player's picking-hand placed through the forearm loop with the instrument disposed generally horizontally with the face and strings facing upward.
Figure 6:
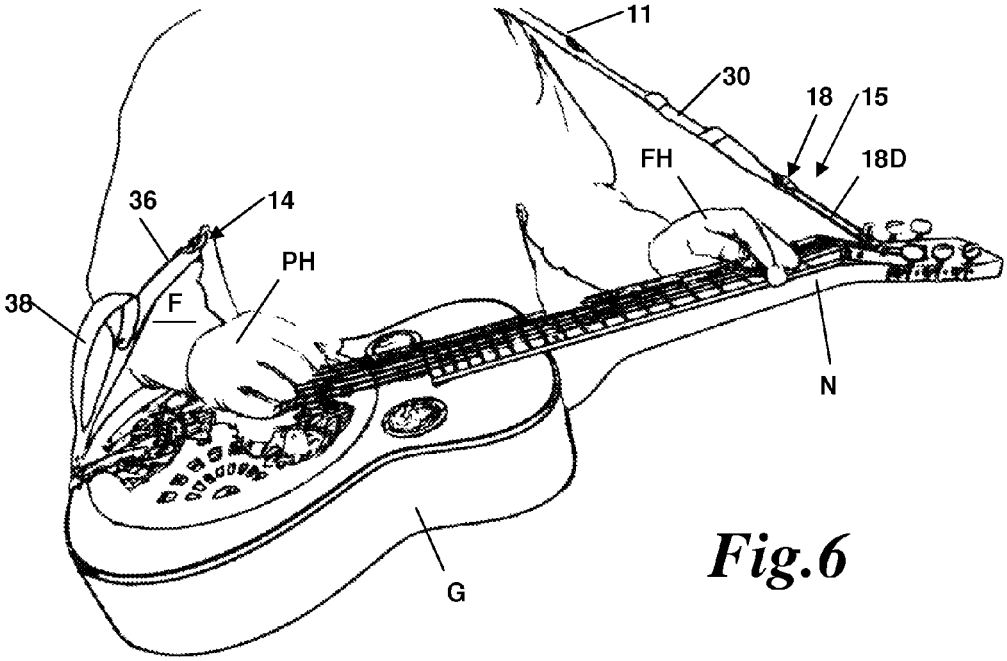
FIG. 6 is a pictorial illustration showing the instrument body strap worn over the top of the player's forearm simulating the most common method of wearing or utilizing a conventional shoulder strap.

As shown in FIGS. 5 and 6, the main shoulder strap 11 is placed over the shoulder of the player's fret-hand FH, and the player's picking-hand PH is placed through the forearm loop 38 such that the forearm loop resides around the top of their forearm F. When properly positioned, the guitar G is disposed generally horizontally with the face and strings of the guitar facing upward.

The flexible cords of the of the quick-release headstock strap assembly 15 provide a first swivel joint between the main shoulder strap 11 and the neck N of the instrument, and the swivel connection 14 between the shoulder strap and the instrument body strap 36 provides a second swivel joint between the shoulder strap and the body of the instrument. These swivel joints allow the shoulder strap 11 to lie flat against the player's back and also allow the forearm loop 38 to lie flat around the top of the forearm F of the picking-hand PH (FIGS. 5 and 6).

Figure 7:
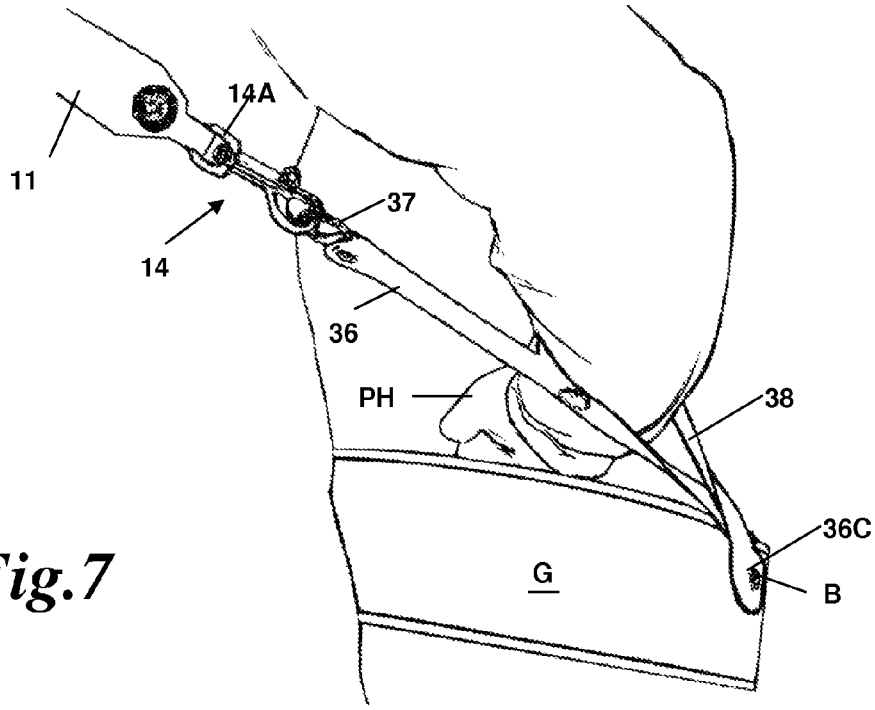
FIG. 7 is a pictorial illustration more clearly showing the swivel connection and the instrument body strap disposed behind the player's back and the player's picking hand passed through the forearm loop.

For purposes of comparison, FIG. 6 shows the instrument body strap 36 worn over the top of the player's forearm F simulating the most common method of wearing or utilizing conventional shoulder straps. In this manner, with conventional straps, the player has difficulty rotating the instrument in a counterclockwise direction (as viewed from the top of the image), while playing, or requiring the use of both hands to move or reposition the instrument. With the present strap, when the forearm F of the player's picking-hand PH placed through the forearm loop 38, as shown in FIGS. 5 and 7, the player is able to precisely move the instrument by moving the picking hand forearm. It should be noted that the range of motion is limited to the strap length, location and method of attachment to the instrument, and by pressing against the player's body.

The ability to switch modes of forearm location is a key feature for players needing to play with the picking hand very far up the neck of the instrument on a particular song. The forearm loop 38 of the present invention allows a similar extended range of motion for the picking hand.

Thus, the forearm loop 38 allows various playing positions and playing angles, and the player's picking-hand forearm is not trapped by the shoulder strap, nor is the forearm subjected to the weight of the instrument or the playing loads applied to the instrument.

FIG. 7 also shows a much clearer view of the swivel connection 14 between the shoulder strap 11 and the instrument body strap 36 disposed behind the player's back and more clearly shows how the picking hand PH passes through the forearm loop 38 without being subjected to the full instrument weight or heavy handed playing load applied in a downward direction. The swivel connection 14 behind the player's back allows for two different fit angles to occur between the main shoulder strap 11 and the forearm loop 38. This arrangement provides an important ergonomic and comfort feature that allows the forearm loop 38 to lie flat along the top of the player's forearm F. The swivel connection 14 also provides a convenient disconnecting means to take off the guitar.

Figure 8:
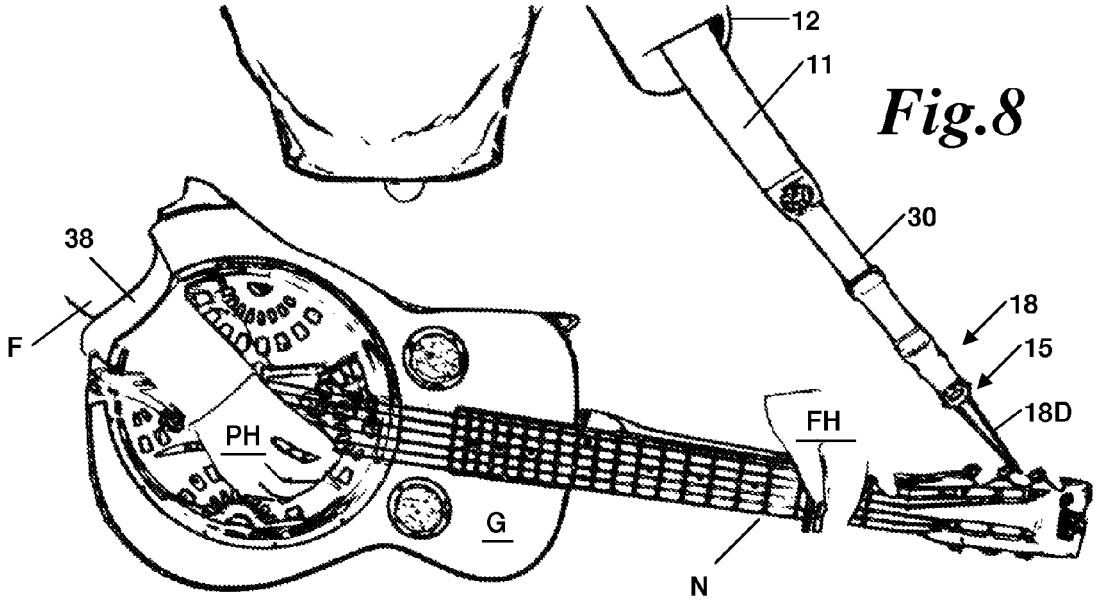
FIG. 8 is a pictorial illustration showing a view looking down on the player's hands in either the sitting or standing position.

FIG. 8 shows a view looking straight down on the player's hands either in the sitting or standing position. As can be seen, the present instrument strap provides side to side stability of the instrument, left to right as shown, while providing ease of rotational stability around the player's body. FIG. 8 also more clearly shows the attachment point of the of the cords of the quick-release headstock strap assembly 15 as far away from the first fret as possible.

Figure 9:
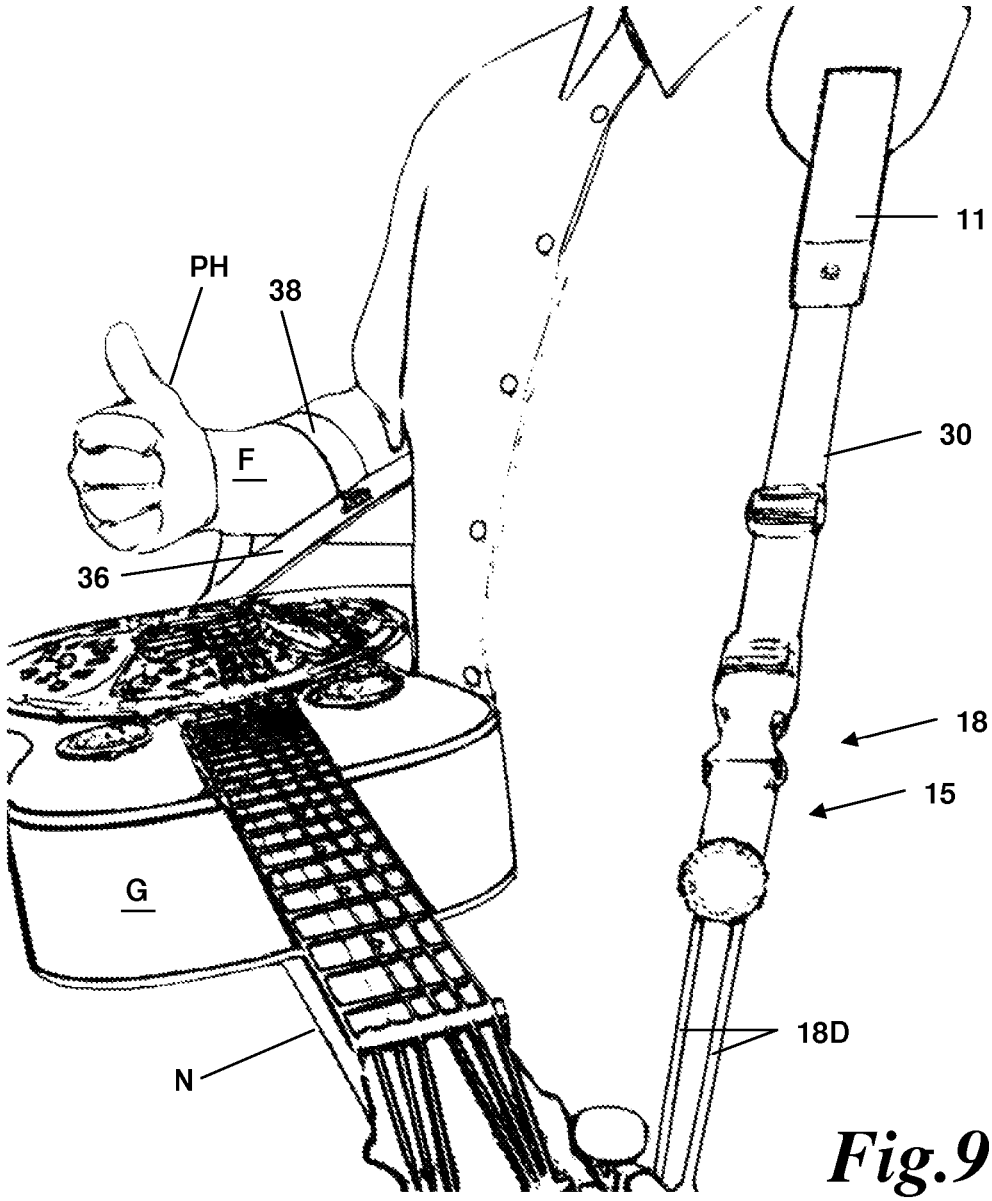
FIG. 9 is a pictorial illustration showing a player with both hands away from the instrument.

FIG. 9 shows a player with both hands away from the instrument. The player is able to move about without losing control of the instrument. This feature is not possible with other known conventional strap designs.

Although the present strap assemblies have been described for purposes of example as being used with a guitar, it should be understood that they may be used with a wide range of different acoustic and electric instruments that may be played in a horizontal position with the playing surface disposed upwardly, such as for example, but not limited thereto, a lute, mandolin, bouzouki, sitar, oud, shoulder synthesizer, or keytar, to name a few. It should also be understood that the present strap assemblies may also be used with other musical instruments, such as shoulder supported keyboards and accordions. It should also be understood that that the present strap assemblies may also be used with various types of tools, such as powered lawn edgers, leaf blowers and vacuums supported in front of a user's body, especially when usage of such tool would be facilitated by a shoulder strap having a forearm loop for supporting and stabilizing the tool and reducing fatigue of the operator.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A shoulder strap assembly worn by a player for supporting a musical instrument in a generally horizontal position with a playing surface of the instrument facing upward, the instrument having a body portion, and a neck portion extending from the body, the strap assembly comprising:

an elongate flexible shoulder strap adapted to be received on a shoulder of the player and having first and second ends;

a first instrument strap releasably connected at one end to said first end of said shoulder strap and having a flexible loop end at an opposed end adapted to be removably attached to the neck portion of the instrument;

a second instrument strap releasably connected at one end to said second end of said shoulder strap and having an opposed end adapted to be removably attached to the body portion of the instrument;

said strap assembly supporting the instrument from the shoulder of the player in a generally horizontal position with the playing surface of the instrument facing upward; and a forearm loop mounted on said second instrument strap to receive a forearm of a first hand of the player such that the forearm is not trapped between the instrument body and said shoulder strap.

2. The shoulder strap assembly according to claim 1, further comprising;

a shoulder pad slidably mounted on said shoulder strap.

3. The shoulder strap assembly according to claim 1, wherein said first instrument strap flexible loop is a flexible cord loop adapted to be removably attached to the instrument neck portion to provide a first swivel joint between said first end of said shoulder strap and the instrument neck portion; and said second instrument strap is releasably connected at one end to said second end of said shoulder strap by a quick-disconnect swivel connection to provide a second swivel joint between said second end of said shoulder strap and the body portion of the instrument; wherein said first swivel joint and said second swivel joint allow said shoulder strap to lie flat against the back of the player, and said second swivel joint allows relative rotation between said second instrument strap and said shoulder strap to prevent said forearm loop on said second instrument strap from binding on the forearm of the player's first hand during playing positions and playing angles.

4. The shoulder strap assembly according to claim 1, wherein said shoulder strap first end has a first element of a quick release coupling secured thereto; and said first instrument strap one end has a mating second element of said quick release coupling secured to said flexible cord loop whereby said first end of said shoulder strap and said first instrument strap are selectively releasably connected and disconnected.

5. The shoulder strap assembly according to claim 1, wherein said shoulder strap second end has a first element of a quick-disconnect swivel connection secured thereto; and said second instrument strap one end has a mating second element of said quick-disconnect swivel connection secured thereto to allow relative rotation therebetween whereby said second end of said shoulder strap and said second instrument strap are selectively releasably connected and disconnected.

6. The shoulder strap assembly according to claim 1, wherein the instrument body has a strap button at an end thereof; and said second instrument strap opposed end has a slotted aperture adapted to be removably received and releasably retained on the strap button.

7. The shoulder strap assembly according to claim 1, wherein said forearm loop is pivotally mounted on said second instrument strap.

8. The shoulder strap assembly according to claim 1, wherein said forearm loop comprises a first and a second flexible strap, each having one end secured to said second instrument strap in longitudinally spaced relation, a buckle is secured to a free end of said first strap, and a free end of said second strap fed though through said buckle to form an adjustable loop that allows the length of said forearm loop to be adjusted to ergonomically fit the forearm of the player.

9. The shoulder strap assembly according to claim 1, wherein said second instrument strap has a plurality of holes formed therethrough in longitudinally spaced relation;

said forearm loop comprises a flexible strap having a first end secured to said second instrument strap and a free end having a hole therethrough; and a separable fastener removably installed through said hole of said forearm loop and a selected hole of said second instrument body strap to allow said forearm loop to be adjusted to ergonomically fit the forearm of the player.

10. A strap assembly worn by a player in a sitting or standing position for supporting a stringed musical instrument in a generally horizontal position with the strings of the instrument facing upward, the instrument having a body, a neck extending from the body and a headstock at an outer end thereof, the strap assembly comprising:

an elongate flexible shoulder strap adapted to be received on a shoulder of the player and having first and second ends;

an instrument headstock strap releasably connected at one end to said first end of said shoulder strap and having a flexible loop end at an opposed end adapted to be removably attached to the instrument headstock;

an instrument body strap releasably connected at one end to said second end of said shoulder strap and having an opposed end adapted to be removably attached to the body of the instrument;

said strap assembly supporting the instrument from the shoulder of the player in a generally horizontal position with the strings of the instrument facing upward; and a forearm loop mounted on said instrument body strap to receive a forearm of a picking-hand of the player such that the forearm is not trapped between the instrument body and said shoulder strap and is not subjected to the weight of the instrument or playing loads applied to the instrument.

11. The strap assembly according to claim 10, further comprising;

a shoulder pad slidably mounted on said shoulder strap.

12. The strap assembly according to claim 10, wherein said instrument headstock strap flexible loop is a flexible cord loop adapted to be removably attached to the instrument headstock to provide a first swivel joint between said first end of said shoulder strap and the headstock; and said instrument body strap is releasably connected at one end to said second end of said shoulder strap by a quick-disconnect swivel connection to provide a second swivel joint between said second end of said shoulder strap and the body of the instrument; wherein said first swivel joint and said second swivel joint allow said shoulder strap to lie flat against the back of the player, and said second swivel joint allows relative rotation between said instrument body strap and said shoulder strap to prevent said forearm loop on said instrument body strap from binding on the player's picking-hand forearm during playing positions and playing angles.

13. The strap assembly according to claim 10, wherein said shoulder strap first end has a first element of a quick release coupling secured thereto; and said instrument headstock strap one end has a mating second element of said quick release coupling secured to said flexible cord loop whereby said first end of said shoulder strap and said instrument headstock strap are selectively releasably connected and disconnected.

14. The strap assembly according to claim 13, wherein the headstock at the outer end of the neck of the instrument includes at a series of tuning knobs or keys connected with the strings; and said flexible cord loop of said instrument headstock strap is releasably secured to the headstock by passing it around the headstock under the strings between the endmost two sets of the tuning knobs or keys and passing said second element of said quick release coupling through said flexible cord loop to secure said instrument headstock strap to the headstock.

15. The strap assembly according to claim 11, wherein said shoulder strap second end has a first element of a quick-disconnect swivel connection secured thereto; and said instrument body strap one end has a mating second element of said quick-disconnect swivel connection secured thereto to allow relative rotation therebetween whereby said second end of said shoulder strap and said instrument body strap are selectively releasably connected and disconnected.

16. The strap assembly according to claim 11, wherein the instrument body has a strap button at an outer end thereof; and said instrument body strap opposed end has a slotted aperture adapted to be removably received and releasably retained on the strap button.

17. The strap assembly according to claim 10, wherein said forearm loop is pivotally mounted on said instrument body strap.

18. The strap assembly according to claim 10, wherein said forearm loop comprises a first and a second flexible strap, each having one end secured to said instrument body strap in longitudinally spaced relation, a buckle is secured to a free end of said first strap, and a free end of said second strap fed though through said buckle to form an adjustable loop that allows the length of said forearm loop to be adjusted to ergonomically fit the forearm of the player.

19. The strap assembly according to claim 10, wherein said instrument body strap has a plurality of holes formed therethrough in longitudinally spaced relation;

said forearm loop comprises a flexible strap having a first end secured to said instrument body strap and a free end having a hole therethrough; and a separable fastener removably installed through said hole of said forearm loop and a selected hole of said instrument body strap to allow said forearm loop to be adjusted to ergonomically fit the forearm of the player.

20. A shoulder strap assembly worn by a user for supporting an instrument or tool, the instrument or tool having a body portion, and a neck portion extending from the body, the strap assembly comprising:

an elongate flexible main shoulder strap adapted to be received on a shoulder of the user and having first and second ends;

a first strap releasably connected at one end to said first end of said main shoulder strap and having a flexible loop end at an opposed end adapted to be removably attached to the neck portion of the instrument or tool;

a second strap releasably connected at one end to said second end of said main shoulder strap and having an opposed end adapted to be removably attached to the body portion of the instrument or tool; and a forearm loop mounted on said second strap to receive a forearm of a first hand of the user.

* * * * *